United States Patent [19]

Kewin

[11] Patent Number: 4,874,139

[45] Date of Patent: Oct. 17, 1989

[54] TUBULAR CORE ASSEMBLIES FOR ROLLS OF PAPER OR OTHER SHEET MATERIAL

[76] Inventor: Daniel Kewin, 16 Dogwood Drive, Brantford, Ontario, Canada, N3R 1R3

[21] Appl. No.: 264,656

[22] Filed: Oct. 31, 1988

[51] Int. Cl.[4] ..... B65H 75/18

[52] U.S. Cl. ..... 242/68.6; 242/118.31

[58] Field of Search ..... 242/68.6, 68.3, 68.4, 242/68.5, 118.31, 71.9; 220/300

[56] References Cited

U.S. PATENT DOCUMENTS

| | | | |
|---|---|---|---|
| 659,306 | 10/1900 | Kingsland | 242/68.6 |
| 1,684,412 | 9/1928 | Reiner | 220/300 |
| 2,076,870 | 4/1937 | Taylor | 242/68.6 |
| 3,194,275 | 7/1965 | Biggs, Jr. et al. | 242/68.5 |
| 3,291,413 | 12/1966 | Cushing et al. | 242/68.6 |
| 3,840,194 | 10/1974 | Vetter | 242/68.6 |
| 3,980,249 | 9/1976 | Cunningham et al. | 242/118.31 |
| 4,334,630 | 6/1982 | Bergin | 220/300 |
| 4,462,556 | 7/1984 | Graham, Jr. | 242/118.3 |
| 4,659,031 | 4/1987 | Saraisky | 242/68.6 X |

*Primary Examiner*—Joseph J. Hail, III

*Attorney, Agent, or Firm*—Robert F. Delbridge; Arne I. Fors

[57] ABSTRACT

A tubular core assembly for a roll of paper or other sheet material has a hollow cylindrical core member formed by multiple wraps of paperboard material, and an annular collar within each opposite end portion of the core member. Each collar is a rigid body with an outer annular surface secured to the inner annular surface of the core member and an inner annular surface having a configuration complementary to the outer annular surface of a roll supporting chuck so that the chuck is receivable therein with a close fit.

6 Claims, 3 Drawing Sheets

TUBULAR CORE ASSEMBLIES FOR ROLLS OF PAPER OR OTHER SHEET MATERIAL

Figure 1:
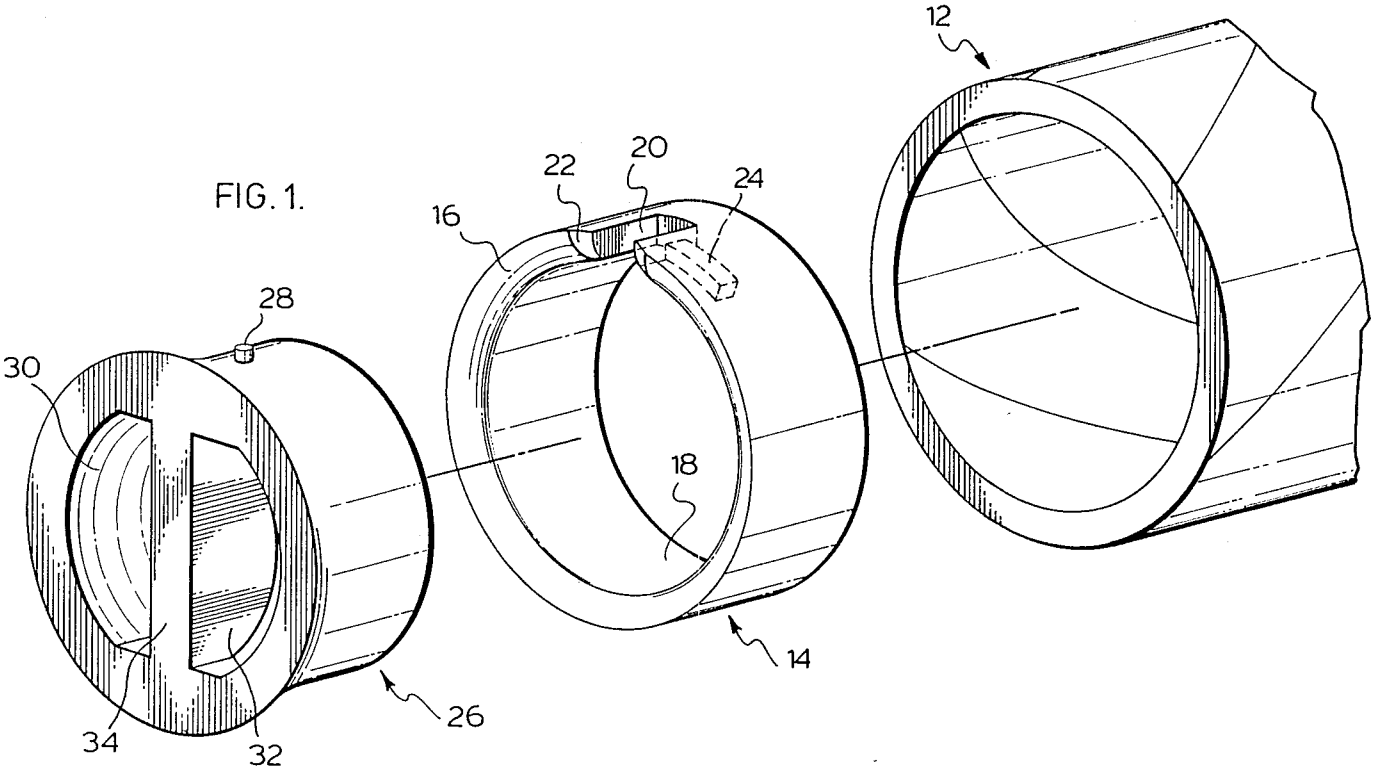

This invention relates to tubular core assemblies for rolls of paper or other sheet material.

In the paper making industry, paper such as newsprint paper is wound on tubular core assemblies to produce a large roll which may be of the order of 5 feet in length and four feet in diameter and which may have a weight of about a tonne, the tubular core assembly usually having a diameter of about four inches. Such rolls are shipped from a papermaking mill to a newspaper press room and, in use, each roll is mounted on a pair of chucks in the form of stub shafts which engage in opposite ends of the core assembly.

Tubular core assemblies which are conventionally used by papermaking mills are the kind which have been used for many years. Modern day newspaper printing presses operate at high speeds, and require that paper be fed thereto from a roll in a properly controlled manner. Because of such requirements, sophisticated computerized equipment has been designed to control variables such as the speed and tension of the paper being fed from a roll to a printing press.

The present invention is based on the realization that at least some of the problems in controlling the supply of paper from a roll to a modern high speed printing press can be attributed to the fact that it has not been realised that conventional tubular core assemblies do not have the necessary characteristics compatible with modern day requirements for feeding paper from a roll to a high speed printing press.

In the past, it has been thought that a major requirement was that a tubular core assembly should have a high compression strength. Thus, a conventional tubular core assembly with a length of about 5 feet has a tubular core member formed from multiple wraps of paperboard material to provide a wall thickness of about 0.5 inches, the multiple wraps being spirally wound with a winding angle usually of the order of about 65 degrees. Such tubular core members are also often provided with a metal end cap fitted over each end of the tubular core member for receiving the stub-shaft chucks when the roll is mounted for supplying paper to a printing press. Each metal cap has a notch for receiving a projection on the chuck.

One of the problems found with feeding paper from rolls with such known core assemblies has been flutter in the paper as it travels from the roll to the printing press. The sophisticated computerized equipment mentioned above is designed to sense such unwanted feed characteristics by adjusting the speed at which the roll is rotated by conventional driving belts, some web vibration usually being absorbed by an idler or dancer roll. However, the problem still has not been satisfactorily overcome, even by use of the most sophisticated computerized equipment available.

The present invention is based on the realization that problems such as flutter are due, at least in part, to bending of the core assemblies, i.e. deformation at the centre relative to the ends. The flutter caused by high speed low amplitude web vibration as an expiring roll becomes smaller results in the paper end having to be transferred to a new roll and cut off from the expiring roll, with a substantial amount of paper being left on the roll end hence becomng scrap. It has been realised that the core assemblies must spin in a substantially dynamically and dimensionally true manner whether the roll is almost full, when the speed of rotation is lower and the weight of paper on the roll is near maximum, or whether the roll is almost expired, when the speed of rotation is high and the weight of the paper is near minimum. It has also been realised that the metal collars do not provide optimum engagement with the stub-shaft chucks, since when undesirable deflection occurs at the centre of the core assembly the metal collars become undesirably misaligned and not in proper engagement with the chucks.

It has thus been realised that end flutter may be caused by a "bent" core which rotates eccentrically, a bent core which semi-disengages from the chuck and therefore vibrates because of its looseness at the chuck, or by an eccentric metal cap or a core which rotates eccentrically at the ends to cause "bumps" or vibration, this being in other words looseness on the chuck.

According to the present invention, a tubular core assembly for a roll of paper or other sheet material comprises a hollow cylindrical core member formed by multiple wraps of paperboard material, and an annular collar within each opposite end of the core member, each collar being formed of a solid body of material and having an outer annular surface secured to the inner annular surface of the core member and an inner annular surface with a configuration complementary to the outer annular surface of a roll supporting chuck so as to receive the chuck therein with a close fit.

For compatibility with existing equipment, the core member of the present invention should have an outer diameter corresponding to the outer diameter of conventional core members, and each collar should have an inner diameter corresponding to the inner diameter of the metal end caps (which is the same as the internal diameter of the core member). Thus, a core member of the present invention will have a wall thickness which is substantially less than that of conventional core members. This smaller thickness enables the multiple wraps of paperboard material to be spirally wound at a winding angle which produces an adequately high beam strength as well as adequate crush strength. Further, the fact that each collar of the present invention is a solid body of material enables the collars to be molded or shaped to fit in a more satisfactory manner on the stub-shaft chucks.

Advantageously, the multiple wraps of paperboard material are wound at a winding angle of from about 15 to about 50 degrees, preferably from about 40 degrees, and still more preferably from about 15 to about 30 degrees. Each collar is preferably formed of compressed wood material, and is advantageously secured by glue to the core member.

Each collar should preferably have an axially extending notch at its front end for receiving the conventional projection on the outer annular surface of a stub-shaft chuck.

The tubular core assembly of the present invention also preferably includes a pair of plugs insertable into the collars at opposite ends of the tubular core assembly, each plug being a solid body of material and having an outer annular surface complementary to that of the inner annular surface of the collar so as to be a close fit therein.

Each plug may have a button-like projection on its outer annular surface, with each collar also having a slot extending in a circumferential direction from the notch so that the button-like projection of a plug can be caused to enter the slot by relative rotation being the tubular core member and the plug so as to lock the plug therein.

Figure 3:
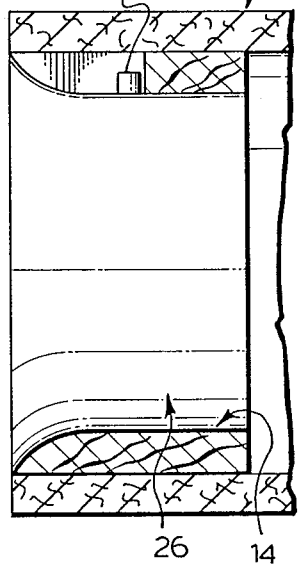
Figure 2:
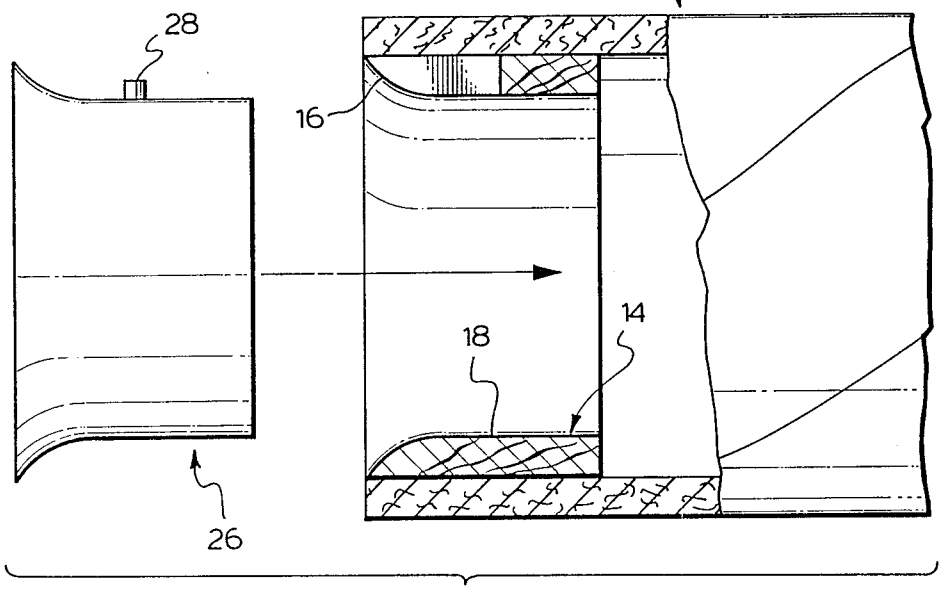
Figure 4:
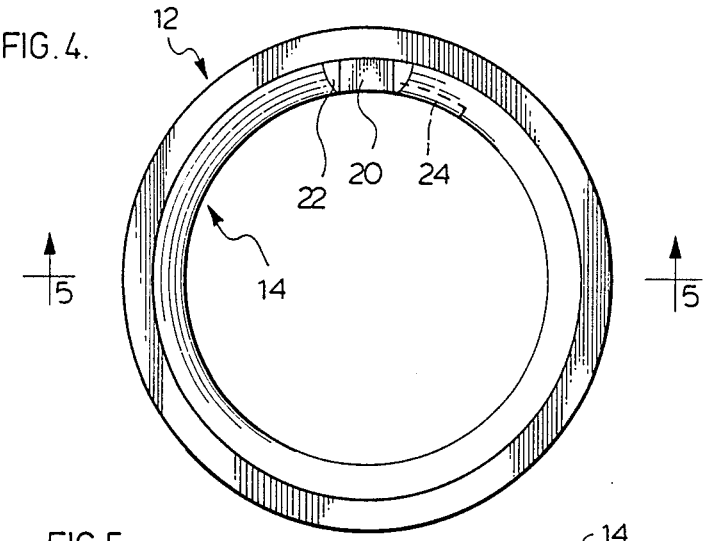
Figure 5:
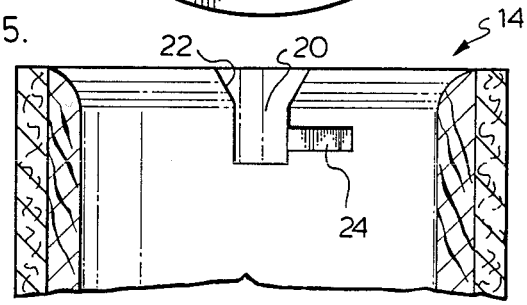
Figure 6:
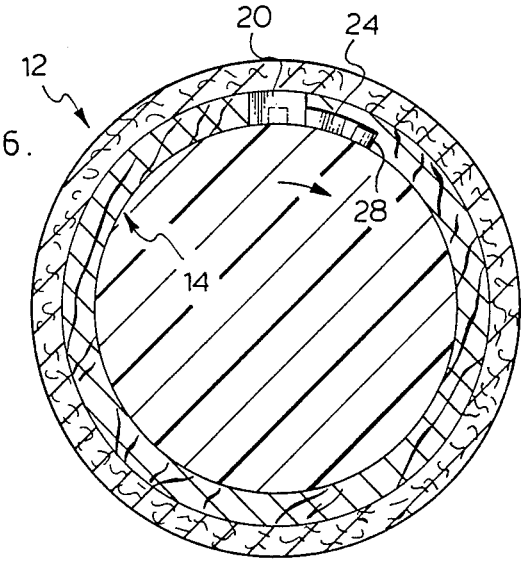

One embodiment of the invention will now be described, by way of example, with reference to the accompanying drawings, which:

FIG. 1 is an exploded perspective side view of one end portion of a tubular core assembly, the other end being identical, FIG. 2 is a side view of the end portion of the core member with the collar secured therein, the plug being shown separate, FIG. 3 is a sectional side view showing the plug positioned into the collar, FIG. 4 is an end view of the core member and collar, FIG. 5 is a sectional view along the line 5—5 of FIG. 4, and FIG. 6 is a transverse sectional view showing the plug locked in engagement in engagement with the collar.

Referring to the drawing, a tubular core assembly for a newspaper roll comprises a hollow cylindrical core member 12 and an annular collar 14 secured within each opposite end portion of the core member 12. The core member 12 is formed from strips (i.e. plies) of spirally wound Kraft paperboard, which is about 90% wood fiber with a thickness of 0.012 inches, these strips having a width of about 10 inches and being wound at a winding angle of about 20 degrees. It has been realised that the core member 12 may in fact be constructed in accordance with the teaching in U.S. Pat. No. 3,194,275 (Biggs Jr. et al) issued July 13, 1965, the contents of which are hereby incorporated herein by reference. The teaching of Biggs Jr. et al is a spirally wound paper tube intended to be used as a core or carrier for heavy sheet material such as carpet material or the like, such tubes normally having a length of the order of twelve feet. In contrast, the core member 12 of the present invention will normally have a length of about 4 to 5 feet. A conventional core member for newsprint rolls is usually formed from plies with a thickness of about 0.035 inches and a width of 4 to 5 inches and a spiral winding angle of about 65 degrees.

The Kraft paperboard referred to above as used in the preferred embodiment of the present invention has relatively long fibers which, when incorporated in a core member 12 formed in the manner described above, become substantially parallel to the length of the core member 12 and assist in maintaining dimensional stability.

The core member 12 is 4.5 feet long with an external diameter of 4 inches and an internal diameter of 3.5 inches i.e. with a wall thickness of 0.25 inches. This is in contrast as a conventional core member which has an external diameter of 4 inches and an internal diameter of 3 inches, i.e. with a wall thickness of 0.5 inches.

Each collar 14 is formed of moldwood, and has an outer annular surface which is a sliding fit within an end portion of the core member 12. The collar 14 is secured in place by a suitable glue, so that torque is properly transmitted from the collars 14 to the core member 12 and so that a positive area contact is provided between the collars 14 and the core member 12 to ensure good load distribution. Also, slippage between the collars 14 and the core member 12 is prevented. The outer diameter of each collar 14 is therefore 3.5 inches, and the internal diameter of each collar 14 is 3 inches, i.e. the same as the internal diameter of a conventional core member. The length of each collar 14 is about 1.5 inches. The front end of each collar 14 is sharply flared at 16 to facilitate entry of a stub-shaft chuck, and the major internal surface 18 of each collar 18 is very slightly flared at an angle of 2 degrees for the same purpose.

The front end of each collar 14 has a notch 20 with a flared entry 22. The initial width of the flared entry 22 is 0.75 inches, and this tapers to a width of 0.6 inches for the remainder of the notch 20. A slot 24 extends in a circumferential direction from the notch 20 so that the plug to be described shortly can be retained in place.

The axially extending notch 20 should have a precise length in the direction of the longitudinal axis of the core member 12 and also a precise width in the circumferential direction such that, when the stub-shaft projection is fully entered into the notch 20, the projection engages the end wall and side walls of the notch 20 and the collar 14 is seated with a close fit on the stub-shaft. Conventional notches are not designed for positional control in this manner, being only intended for torque transmission. They are usually too wide and too short to achieve such positional control.

With the present invention, the width of the notch 20 is such that the stub-shaft projection is a close fit widthwise to prevent radial oscillation of the core member 12 relative to the stub-staff, thereby minimising web flutter, core end distortion and consequent looseness and inclination particularly when a roll is nearly expired.

The precise notch width and length together provide a further benefit in that the full internal annular surface of the collar 14 is maintained in gripping engagement around the stub-shaft over its full length, thereby resisting retraction of the core member 12 due to any lateral distortion at the central portion of the core member 12, the result being reduced looseness on the stub-shaft.

The tubular core assembly also includes a plug 26 for each collar 24. The plugs 26 are preferably of molded material, as also are the collars 14. In this embodiment, each plug 26 is of high density moldwood, the same as the collars 14, and shaped to form a close fit in the collars 14 as shown in FIG. 5. Each plug 26 has a button-like projection 28 which, when the plug 26 is inserted to a collar 14, can be caused to enter the slot 24 by relative rotation between the plug 26 and the collar 14, thereby locking the plug 26 in engagement with the collar 14. The front end surface of each plug 26 has two laterally spaced recesses 30, 32 to provide a grip bar 34 which can be manually gripped to facilitate insertion and removal of the plug 26.

The above described tubular core member 12 has adequate crush strength, but more importantly has improved beam strength so that distortion by bending is minimised, with the result that the seating of the collars 14 on the stub-like chucks remains satisfactory for different rotational speeds and so that flutter in the supply of paper from a roll to a printing press is minimized, thereby improving print register and reducing the amount of paper which has to be left as scrap on a spinning roll. The collars 14 are more resistant to deformation by torque and to radial compression than the tubular core member 12, this being an advantage because it is at the ends where such properties are most required. The fact that the collars 14 are of molded material provides dimensional precision and stability, especially with respect to the notch 20 which has to properly engage the projection on chuck stub-shaft. Also, such collars are less compressible than paper board, thereby providing better weight and torque distribution.

Since the collars 14 are inserts in the core member 12 and are composed of non-isotropic material, they will not transmit impact distortion from their outside perimeters to their inside perimeters. This is in contrast to metal end caps which are isotropic and do transmit such distortion, with the result that impacts during shipping may produce an eccentric inner rim which will not fit on the chuck stub-shaft.

The plugs 26, being also of molded material, also have dimensional precision and stability, as well as impact strength, with resultant advantages in shipping and storing of paper rolls.

A particular advantage of the above described embodiment is that the core member 12, the collars 14 and plugs 26 are made of material which can be economically recycled. This is of course in contrast to conventional core members with or without metal end caps.

Other advantages of the invention will be readily apparent to a person skilled in the art, the scope of the invention being defined in the appended claims.

I claim:

1. A tubular core assembly for a roll of paper or other sheet material comprising:

a hollow cylindrical core member formed by multiple wraps of paperboard material, an annular collar within each opposite end portion of the core member, each collar being a rigid body of non-isotropic material and having an outer annular surface glued to the inner annular surface of the core member and an inner annular surface having a configuration complementary to the outer annular surface of a roll supporting chuck so that the chuck is receivable therein with a close fit and a pair of plugs insertable into the collars at opposite ends of the tublar core assembly, each plug comprising a body of non-isotropic material with a solid cross-section having an uninterrupted circular outer circumference, each plug having a length substantially equal to the length of the collar, and each plug having an outer annular surface complementary to that of the internal annular surface of the collar so as to be a close fit therein.

2. A tubular core assembly according to claim 1 wherein the core member is formed of multiple wraps of paperboard material which are spirally wound at a winding angle of from about 15 to about 50 degrees.

3. A tubular core assembly according to claim 2 wherein the winding angle of the spirally wound multiple wraps is from above 15 to about 40 degrees.

4. A tubular core assembly according to claim 3 wherein the winding angle of the spirally wound multiple wraps is from about 15 to about 30 degrees.

5. A tubular core assembly according to claim 1 wherein each collar is formed of compressed wood material.

6. A tubular core assembly according to claim 1 wherein each collar has an axially extending notch with a flared entry extending rearwardly from its front end, said notch being shaped rearwardly of the flared entry so as to be a close fit with a mating projection on the outer annular surface of a roll supporting chuck.

* * * * *